US007546710B2

(12) United States Patent
Abbott

(10) Patent No.: US 7,546,710 B2
(45) Date of Patent: Jun. 16, 2009

(54) FLOODWATER BARRIER

(75) Inventor: Steven Abbott, Norwich (GB)

(73) Assignee: Flood Ark Limited (GB)

( * ) Notice: Subject to any disclaimer, the term of this patent is extended or adjusted under 35 U.S.C. 154(b) by 475 days.

(21) Appl. No.: 10/478,543

(22) PCT Filed: May 22, 2002

(86) PCT No.: PCT/GB02/02221

§ 371 (c)(1),
(2), (4) Date: Jun. 24, 2004

(87) PCT Pub. No.: WO02/095175

PCT Pub. Date: Nov. 28, 2002

(65) Prior Publication Data

US 2004/0231280 A1 Nov. 25, 2004

(30) Foreign Application Priority Data

May 23, 2001 (GB) ..... 0112468.4
May 4, 2002 (GB) ..... 0210217.6

(51) Int. Cl.
*E06B 9/06* (2006.01)

(52) U.S. Cl. ..... 52/202; 52/213; 52/208; 52/656.1; 52/169.14

(58) Field of Classification Search ..... 52/169.6, 52/169.14, 202, 213, 215, 208, 656.1; 405/114, 405/107, 91, 100, 115, 87; 49/55, 61
See application file for complete search history.

(56) References Cited

U.S. PATENT DOCUMENTS 2,848,762 A * 8/1958 Peterson ..... 52/127.6
3,028,938 A * 4/1962 Schorr ..... 52/464
3,434,689 A * 3/1969 Aftreth ..... 249/193
3,766,698 A * 10/1973 Dallen ..... 52/204.597
3,861,081 A * 1/1975 Maskell ..... 49/70
4,132,390 A * 1/1979 Pfarr, Jr. ..... 256/24
4,586,301 A * 5/1986 Hickman ..... 52/96
4,735,395 A * 4/1988 Dahowski ..... 249/10
5,077,945 A * 1/1992 Koeniger ..... 52/169.14
5,107,646 A * 4/1992 Tamura ..... 52/208
5,339,584 A * 8/1994 Ohtake et al. ..... 52/208
5,943,832 A * 8/1999 Russell ..... 52/202
6,179,521 B1 * 1/2001 Muramatsu et al. ..... 405/115
6,425,707 B1 * 7/2002 Baxter ..... 405/87
6,427,396 B1 * 8/2002 Harrison ..... 52/202

(Continued)

*Primary Examiner*—Richard E Chilcot, Jr.
*Assistant Examiner*—Chi Q Nguyen
(74) *Attorney, Agent, or Firm*—Galgano & Associates, PLLC

(57) ABSTRACT

An apparatus to protect an aperture of a building and/or a closure means associated with the aperture from floodwater has a barrier housing (40), which is removably fixable to at least a portion of the periphery of the aperture. The banner housing (40) includes a channel (44) into which a barrier member (10) can slide, forming a seal. A resilient layer (61) is included between the barrier housing (40) and the barrier member (10). The resilient layer (61) can include one or more splines (62). A compression means (90) can be included to urge the housing (40) and the barrier member (10) together to form a seal. Further sealing material, in the form of a member of strips (70), can be included between adjacent barrier members (10). The strips (70) are attached to the in-use upper surface of a barrier member (10), and engage the in-use lower surface of an adjacent barrier member.

77 Claims, 13 Drawing Sheets

U.S. PATENT DOCUMENTS 6,591,553 B1 * 7/2003 Vaughn ..... 49/466
6,623,209 B1 * 9/2003 Waters, Jr. ..... 405/94
7,104,015 B2 * 9/2006 Huynh ..... 52/208
7,121,764 B2 * 10/2006 Rorheim ..... 405/107

* cited by examiner

FLOODWATER BARRIER

FIELD OF THE INVENTION

The present invention concerns an apparatus for use in preventing flood water reaching an entry point such as a door, window or air brick of a building. The apparatus is particularly adapted to be demountable and to be used with existing doorways and windows.

BACKGROUND TO THE INVENTION

Floodwaters, particularly from swollen rivers and high tides can cause widespread and costly damage. The damage caused is not only to crops, roadways and other externally located constructions which become at least partially submerged, but also to the interiors of properties such as warehouses or domestic dwellings. The apparent increase in the frequency of floodwater causing such damage has highlighted the costs involved in reparation and that these costs are borne principally by insurance companies or property owners.

The problem of the flooding of domestic dwellings has recently increased, due to changes in government policy regarding where new housing may be located. Previously, it has been the case that due to the number of houses which needed to be built, and the amount of land available, locations for new houses could be chosen which did not lie in areas known to be prone to flooding, such as areas of a river's flood plain. However, due to the increased drive towards the construction of new homes and the lack of suitable space now available, the criteria for assessing whether land is fit for the purposes, of construction have been relaxed and an increasing number of buildings are now at risk.

Furthermore, the increased coverage of formerly agricultural or open land with concrete has the result that less rainwater is absorbed by the ground. Instead, the water flows rapidly over the concrete into the sewerage system and then into already swollen streams and rivers. The streams and rivers therefore reach a higher water level, more rapidly than was previously the case, placing buildings, which were formerly safe from flooding, at risk.

A number of methods are known, which reduce or prevent from flood water from entering into a dwelling. The most common of these methods is to stack sand bags against the particular entry point which is at risk. This can however be a difficult and arduous task and is not at all suitable for those who are infirm or who have difficulty in lifting and maneuvering the sand bags into position. Furthermore, even where a sand bag barrier has been constructed, it is normally not water-tight, but allows water to seep either through the main body of the sand bag, or between neighbouring sand bags. Moreover, once the flood water has passed, the user is then left with the problem where to store the sand bags and also with the problem of how to prevent the material from which the bag itself is formed from rotting. The latter problem is particularly acute where sacking is used to form a bag.

An alternative solution is to provide a housing around a portion of the periphery of an aperture. Housing known in the art often has a U-shaped channel into which panels are slotted, panels co-operating to form a barrier. Sealing material, often formed of strips of rubber is provided on either or both of the panel or the channel so that a water-tight seal is produced. The rubber strips need therefore to engage closely with another part of the barrier in order to produce a good seal. Due to the close engagement of the act of pushing a barrier into a U-shaped channel can be difficult and also cause damage to the sealing material due to friction.

It is an object of the present invention to seek to alleviate the above disadvantages and to provide an apparatus which provides a removable barrier to prevent flood water entering a building.

It is a further object of the invention to reduce the need to employ sand bags or the number of sand bags required to prevent water from entering through an aperture of a building.

SUMMARY OF THE INVENTION

According to the invention, there is provided an apparatus to protect the aperture of a building and/or the usual closure means associated with the aperture, for example a door or a window, the apparatus acting to prevent or substantially hinder water from penetrating said aperture, the apparatus comprising:

a barrier housing removeably fixable to at least a portion of the periphery of the aperture; and a barrier member sealingly engageable with the housing to provide a water-tight seal, a compression means to urge the barrier member into sealing engagement with the barrier housing, whereby, when it is anticipated that flood waters will rise high enough to penetrate an aperture of a building, the housing is fixed into position around a portion of the periphery of the aperture, the barrier member sealingly engages and co-operates with the housing to form a barrier to prevent floodwater entering the aperture.

The compression means increases the strength of a seal and can enable a barrier to be rapidly assembled. The compression means also obviates the need for the barrier housing to include a U-shaped channel as the compression means can hold the barrier member in the correct sealing position.

A resilient layer is preferably included between the barrier housing and the barrier member, the resilient layer improving the water sealing properties of the apparatus. Optionally, the resilient layer is permanently attached to the barrier housing.

The barrier member is preferably planar, rectangular in shape in order to be easily stackable and storable when the apparatus is not in use. Advantageously, the barrier member is hollow and includes one or more strengthening members to strengthen the panel. A balance between strength and weight is thereby achieved for the panel.

A sealing means is preferably included between the barrier housing and the building to prevent ingress of water between the housing and the building. The sealing means is advantageously a strip of resilient material, such as rubber or closed cell silicone material, the strip flowing under pressure to conform with the shape of the building and/or the barrier housing and thus provide a water-tight seal.

One or more strips of sealing material, can be provided along the barrier member, again to increase the water resistant properties of the apparatus.

The barrier housing advantageously includes a channel into which the barrier member can slide, the barrier member thus being easily engageable and removable with the housing.

The compression means optionally includes a pawl, rotatable between a rest position and a housing-engaging position. Advantageously, rotation of the pawl causes the barrier member and the barrier housing to be urged together. A cam mechanism can be included to provide the force necessary.

The or each barrier member can include one or more barrier member-engaging portions to enable a number of barrier members to be fitted together to form a barrier of increased size. The barrier can thus be increased in height sequentially, as the height of the flood water rises. The step-wise assembly of a barrier, has a number of advantages. Firstly the problems of transportation and storage of a number of smaller barrier sections is smaller than is the case when one large section is involved. Secondly, where an eventually high flood water level is expected, but the level is still at a relatively low level, the aperture may continue to be used with the minimum of difficulty.

According to a further aspect of the invention there is provided a method of preventing water from entering an aperture, the method comprising the steps of:

(i) fixing a housing around a portion of the periphery of the aperture;

(ii) engaging a barrier member with the housing;

(iii) compressing the barrier member against the housing to produce a water-tight seal;

(iv) maintaining the compressive force between the barrier member and the housing.

BRIEF DESCRIPTION OF THE DRAWINGS

The invention will now be described with reference to the accompanying drawings, which show by way of example only two embodiments of a flood water prevention apparatus. In the drawings.

DETAILED DESCRIPTION OF THE INVENTION

Figure 1A:
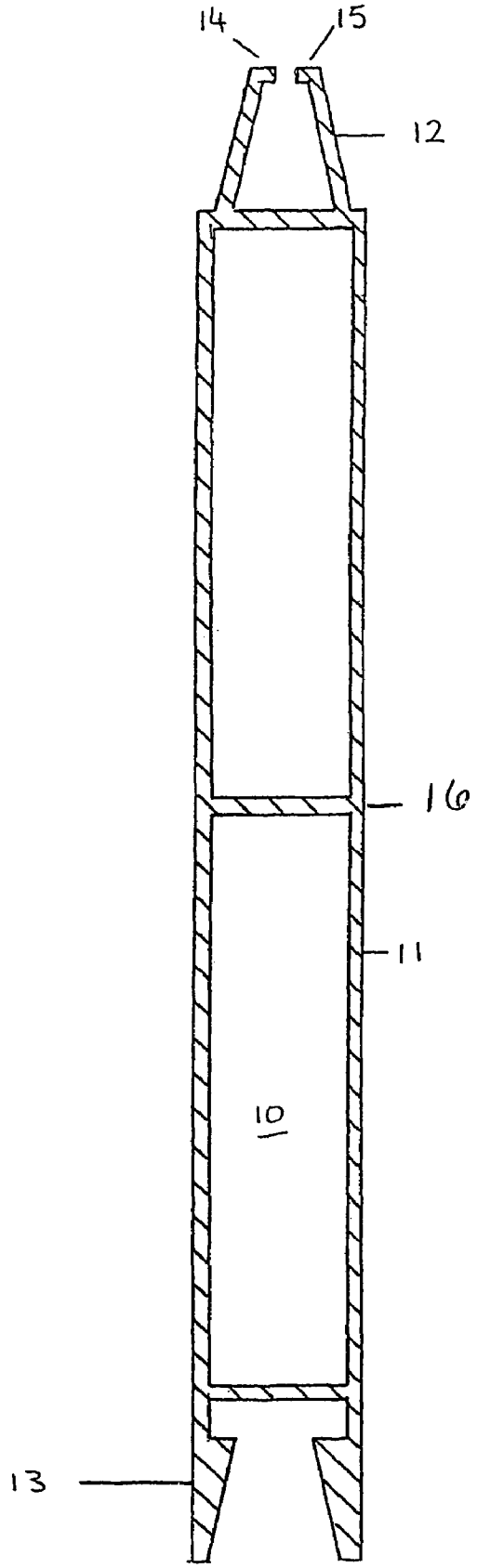
FIG. 1*a* is a sectional view of the side of a first embodiment of a panel.
Figure 1B:
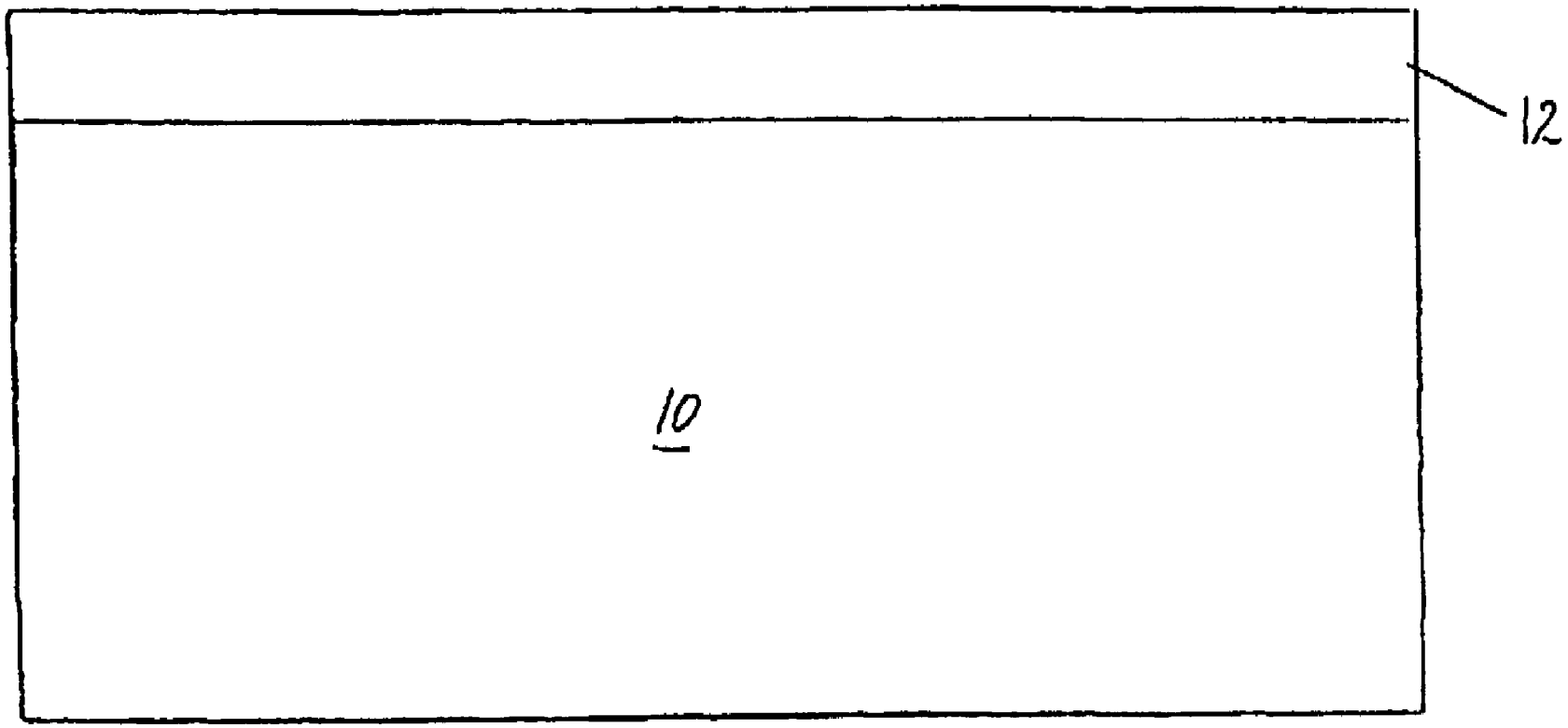
FIG. 1*b* is a front view of the panel of FIG. 1*a,*

In FIG. 1, a panel 10 comprises a surface 11, which, in use, faces and engages the flood waters and prevents their entry through an aperture of a building. The panel 10 has an upper panel-engaging portion 12 and a lower panel-engaging portion 13. The upper and the lower panel-engaging portions 12,13 run the length of the panel 10, and in use co-operatively sealingly engage with the corresponding lower and upper portions of further panels 10. The upper panel-engaging portion 12, has two flanges 14,15 extending inwardly. The panel 10 is hollow, a cross-piece 16 providing additional strengthening to the panel.

Figure 2:
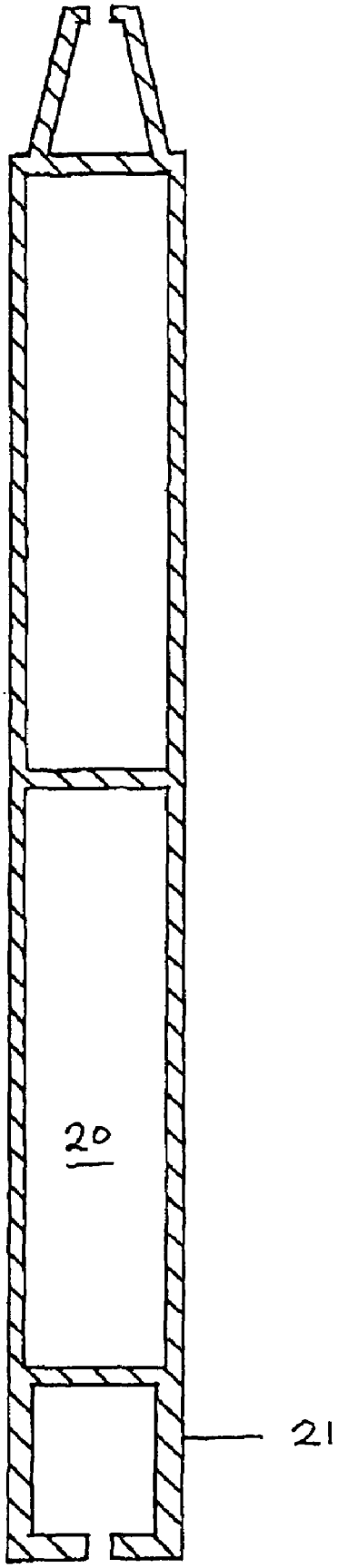
FIG. 2 is a sectional view of the side of a second embodiment of a panel.
Figure 3:
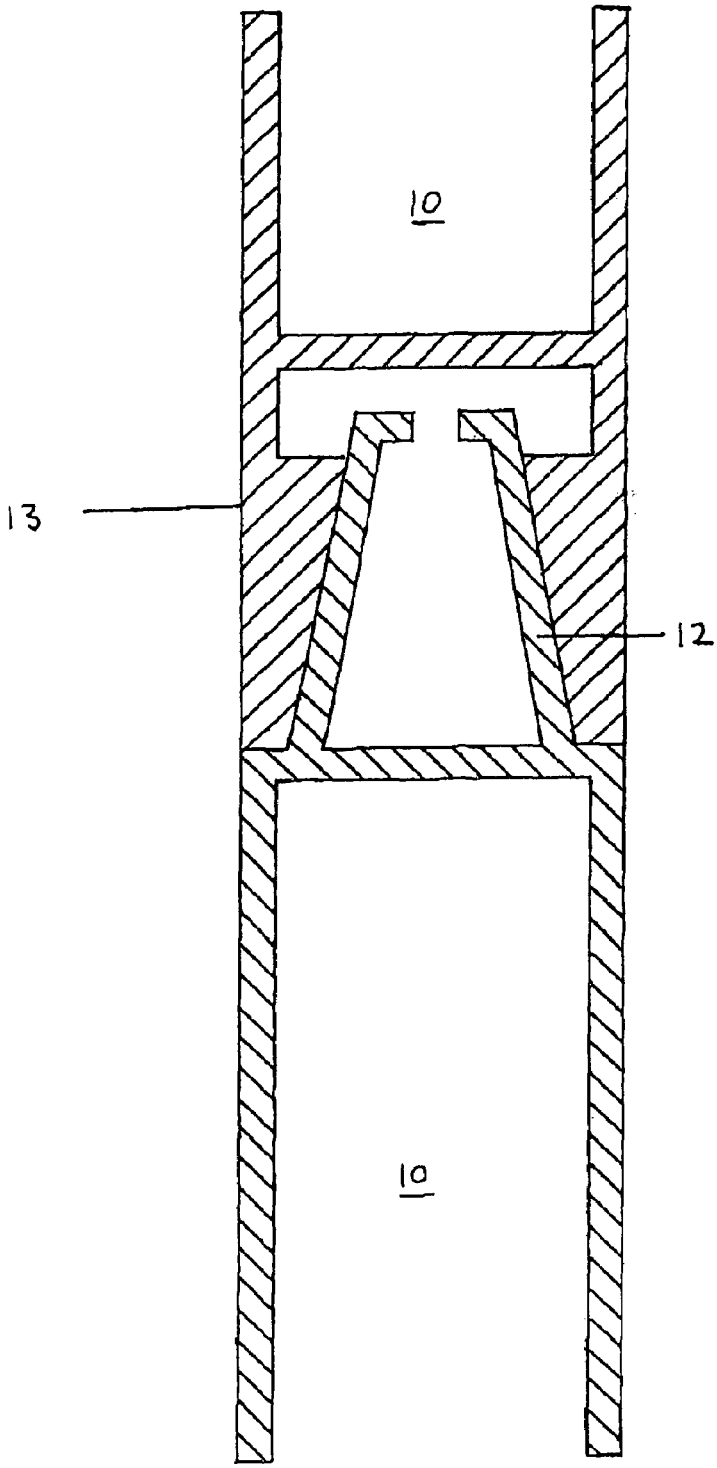
FIG. 3 illustrates the interaction of two panels according to FIG. 1 to construct a barrier.

The panel 20 of FIG. 2, illustrates a further configuration of a lower panel-engaging portion 21. FIG. 3 illustrates two panels 10 co-operating to form a water-tight seal. Barriers to prevent flood waters from entering through an aperture can thus be built up in height, in accordance with the height of the flood water.

Figure 4:
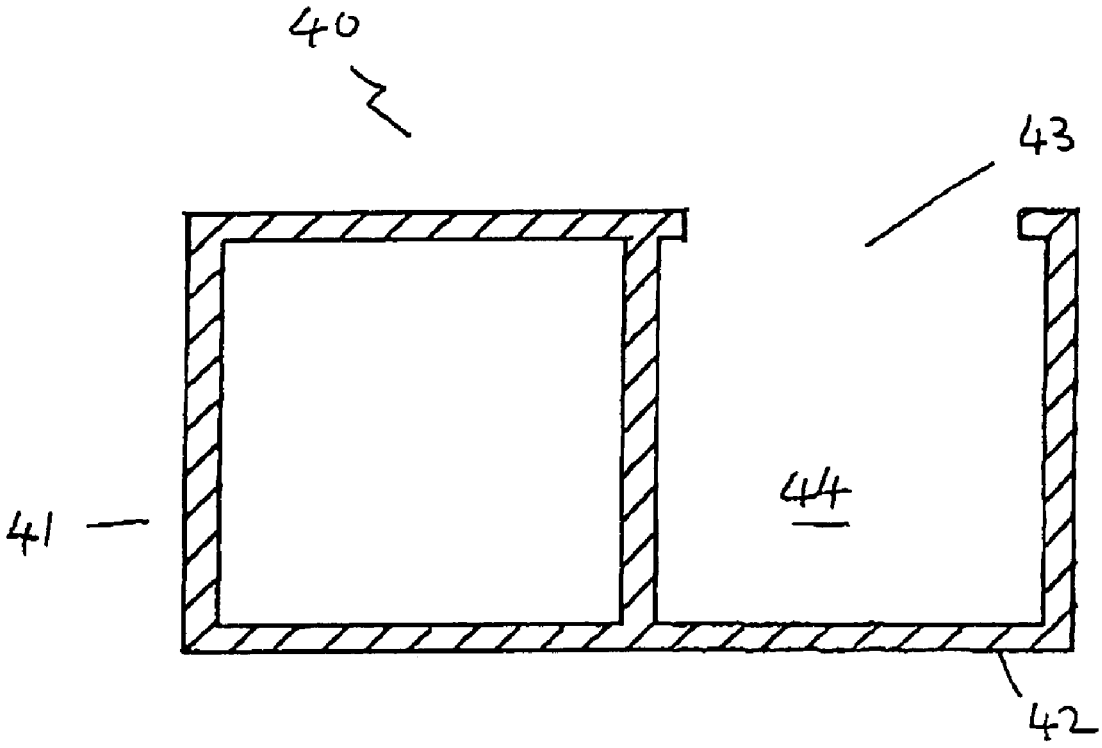
FIG. 4 is a section through a first embodiment of a peripheral housing member.
Figure 5:
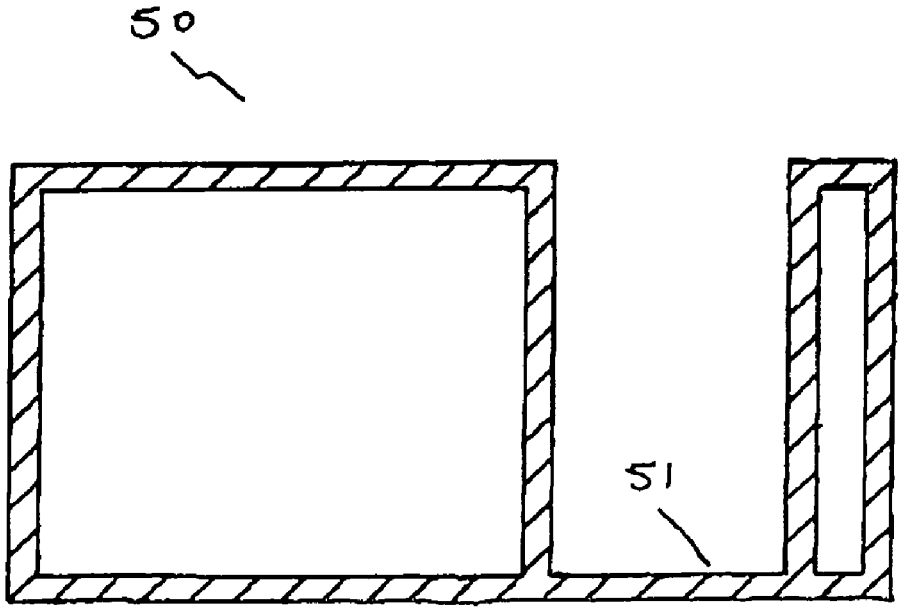
FIG. 5 is a section through a second embodiment of a peripheral housing member.

FIG. 4 illustrates a housing 40 to retain the panels 10,20 of FIGS. 1 and 2. The housing 40 is elongate in form and comprises a support element 41, having a square cross-section. The housing 40 also has a panel retention element 42, also having a substantially square cross-section, partially open along one of the edges 43, forming a channel 44 to receive a panel. The housing 50 of FIG. 5, also rigged to retain panels, differs from the housing 40 of FIG. 4 in that the panel retention element 51 has a substantially rectangular cross-section and is moreover completely open along one edge to receive the panel.

Figure 6:
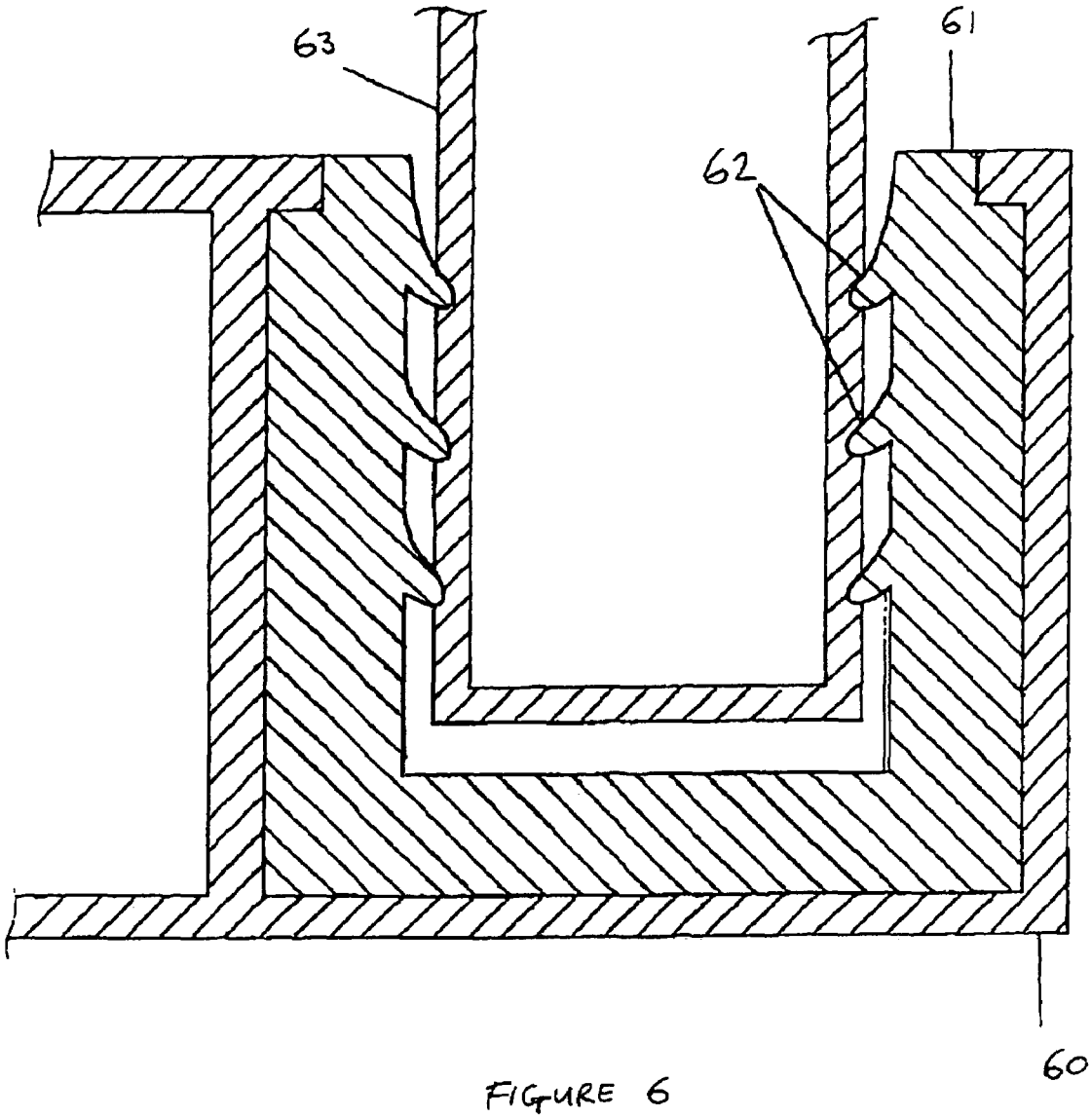
FIG. 6 illustrates the side of a panel located within the peripheral housing as shown in FIG. 4.

As illustrated in FIG. 6, the panel retention element 60 has inner edges lined with a lining 61. The lining 61 is formed from a resilient material such as rubber or closed cell silicone material. The lining 61 is bonded to the surface of the retention element 60 by means of a suitable adhesive. In addition, a number of splines 62 protrude from the lining 61, the splines engaging an edge of a panel 63 to form a water-tight seal.

Figure 7:
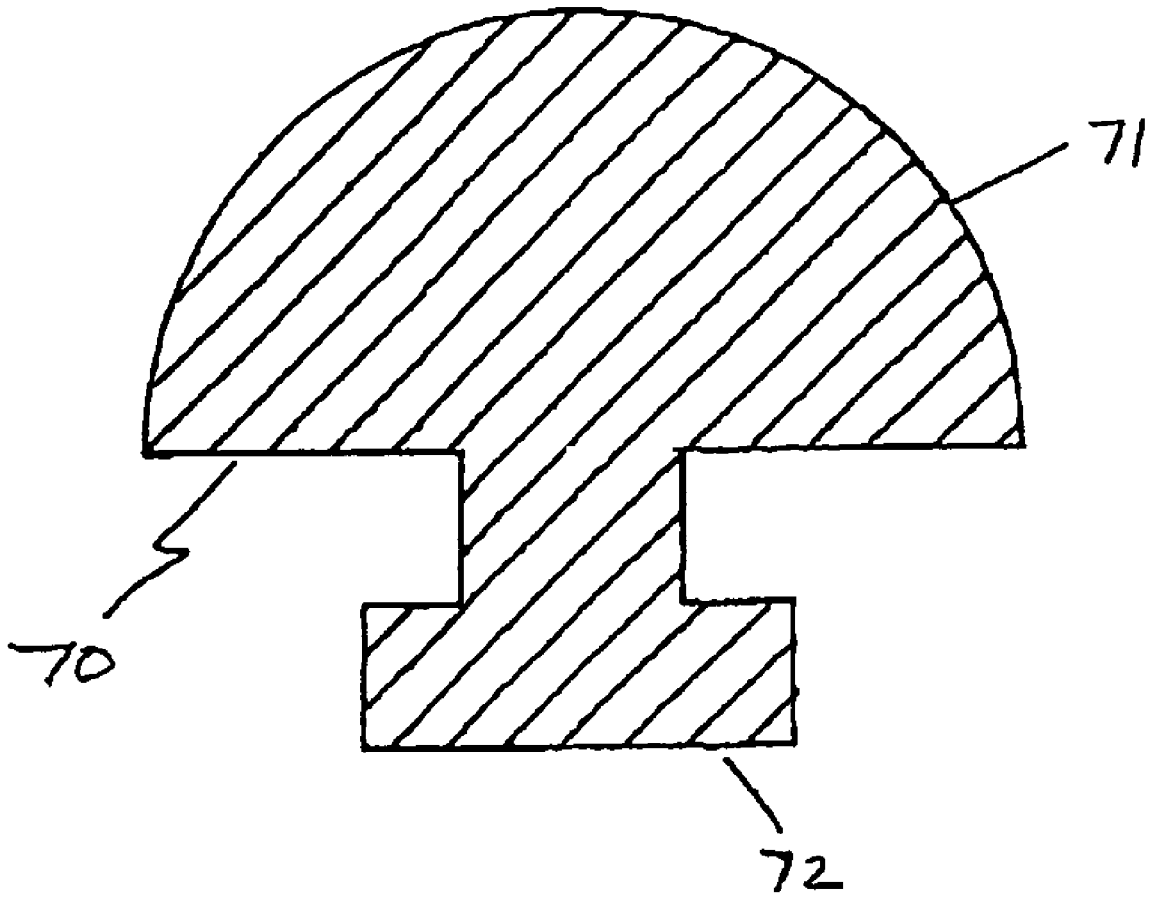
FIG. 7 shows a top sealing member in cross-section.
Figure 8:
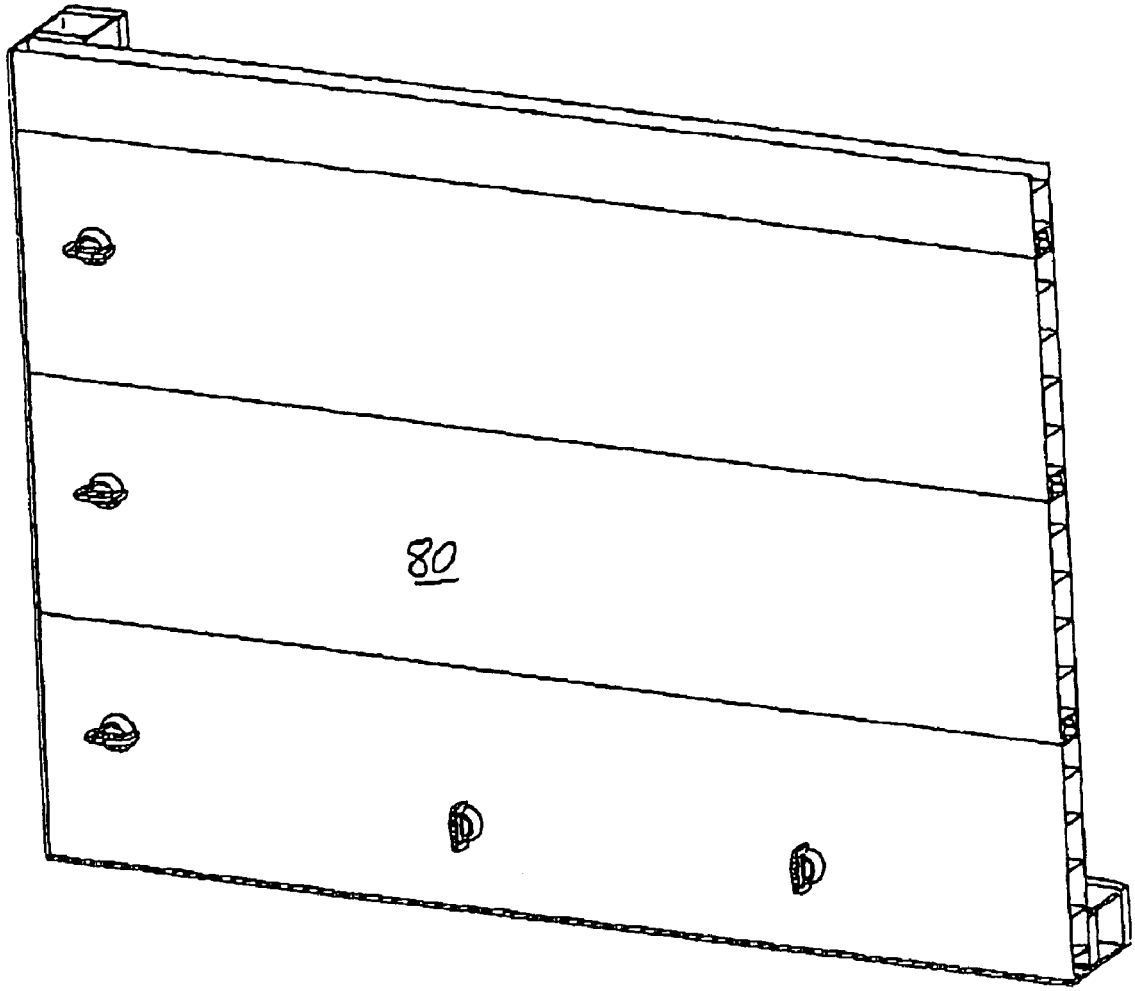
FIG. 8 is a partial front perspective view of panels assembled together.
Figure 9:
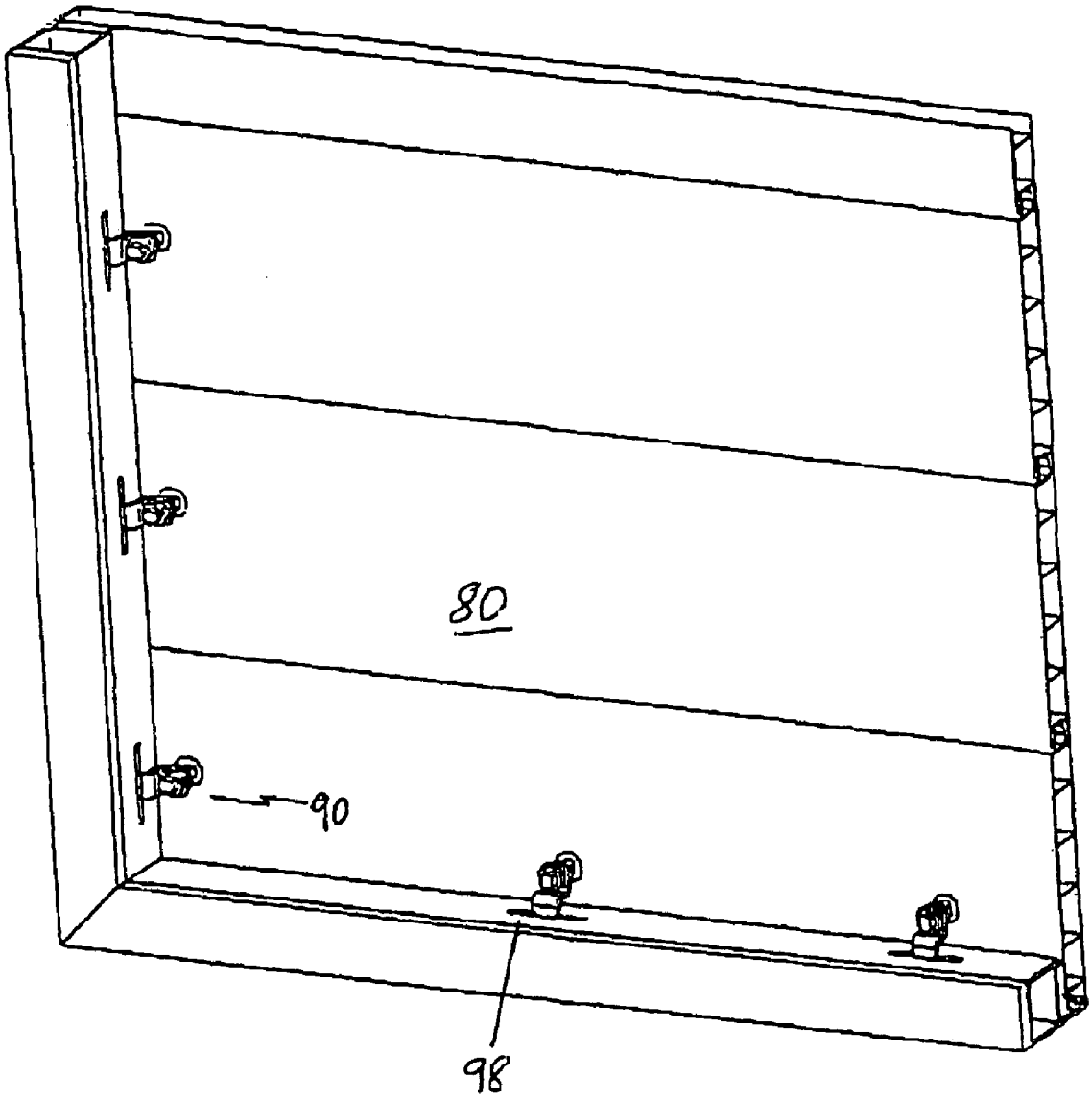
FIG. 9 is a further partial rear perspective view of panels assembled together.
Figure 10:
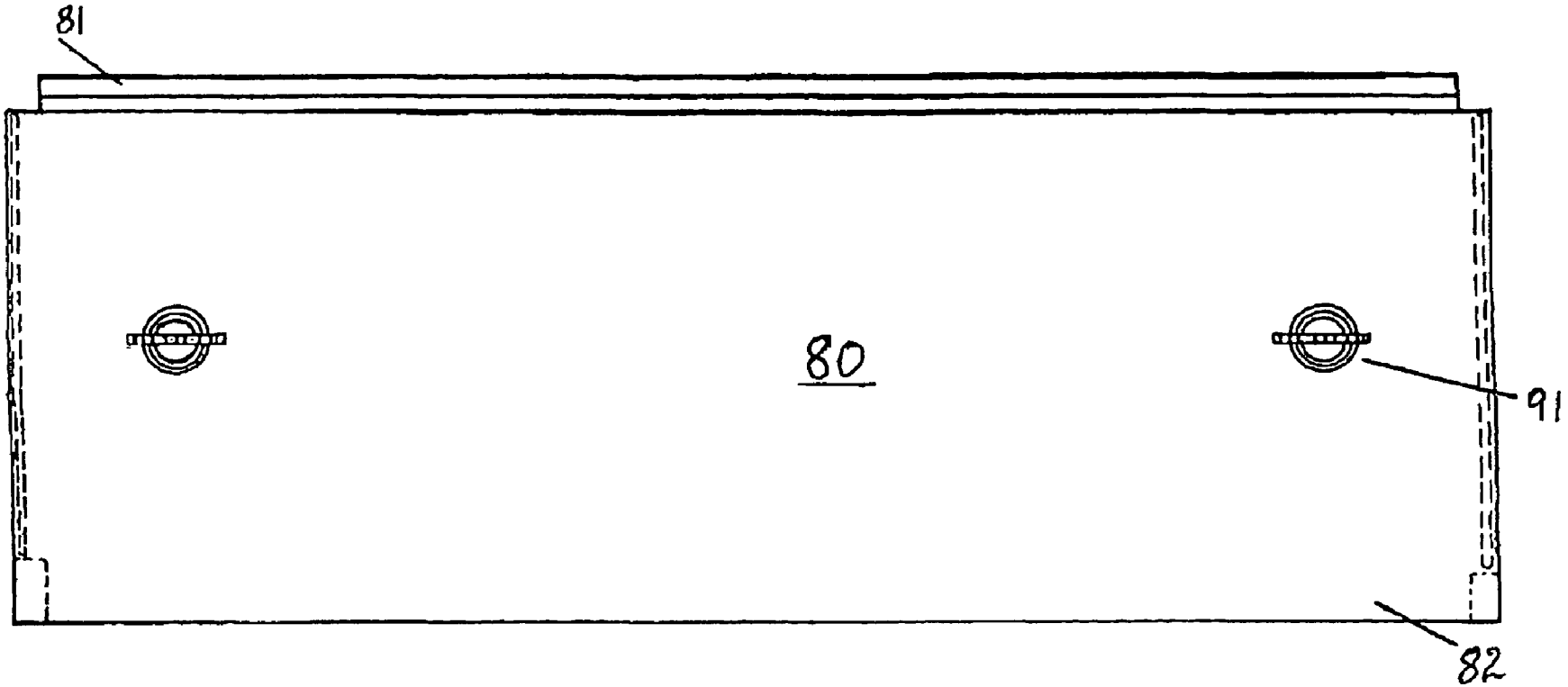
FIG. 10 is an elevational view of a third embodiment of panel.
Figure 11:
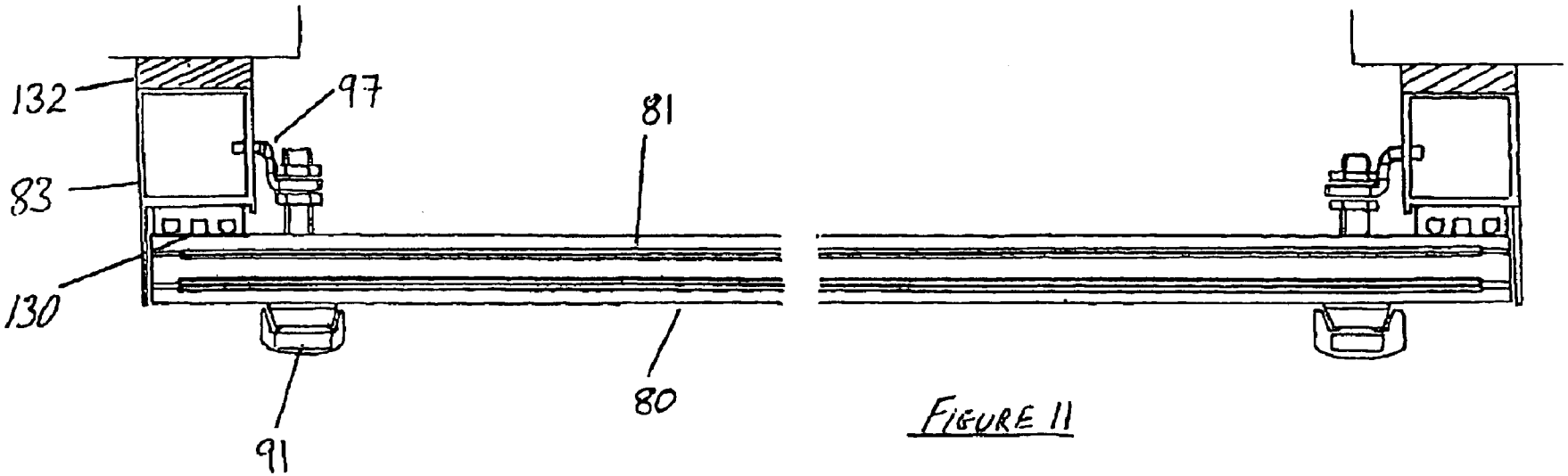
FIG. 11 is a sectional view of the panel shown in FIG. 10.
Figure 13:
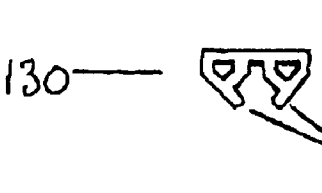
FIG. 13 is a sectional view through a third embodiment of a peripheral housing member.
Figure 12:
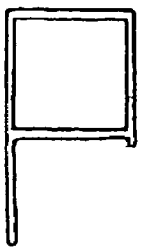
FIG. 12 is a top view of the panel shown in FIG. 10 secured within a peripheral housing member.
Figure 15:
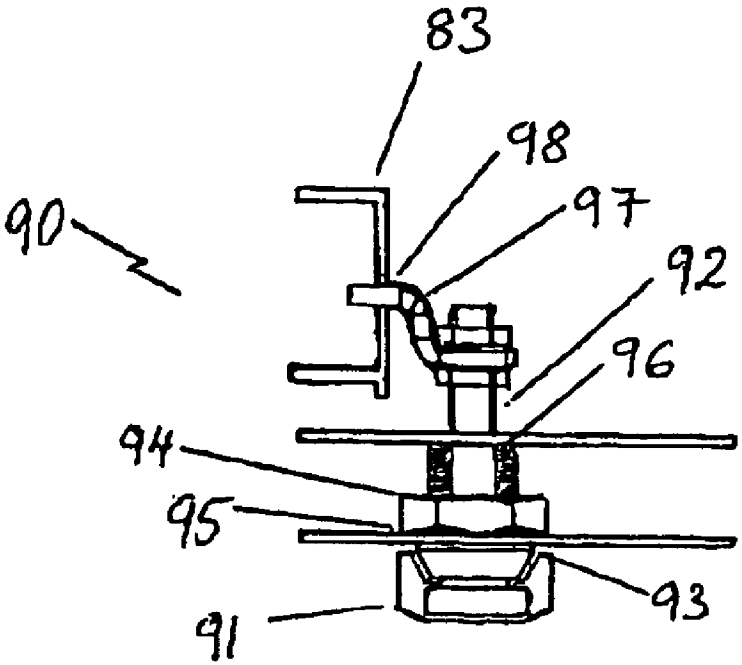
FIG. 15 illustrates a compression latch.
Figure 14:
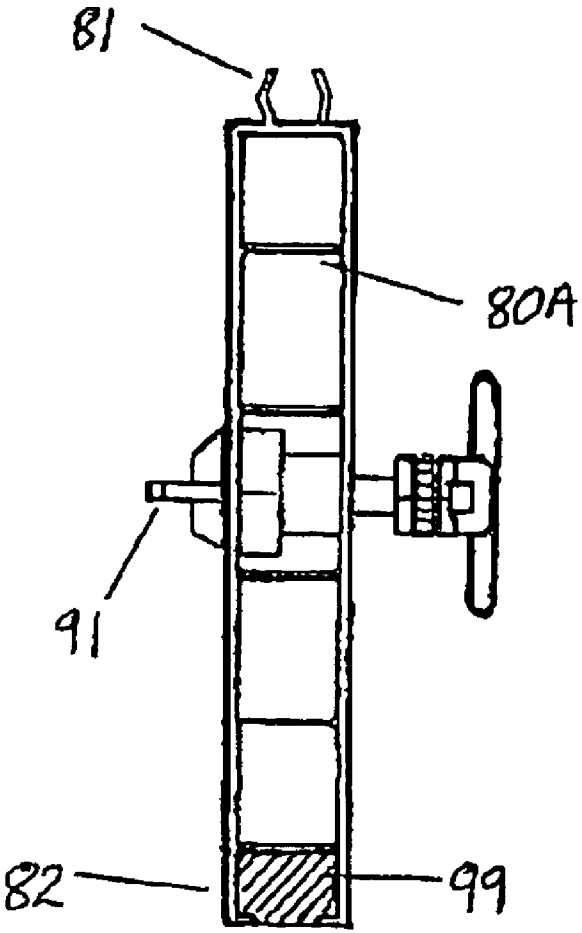
FIG. 14 is a sectional view of a neoprene moulding seal.

FIG. 7 illustrates a further elongate sealing member 70. The cross-section of the sealing member 70 has essentially two portions; a hemispherical portion 71 and a "T"-shaped portion 72, which in use engages a panel 10,20. The stem of "T", passes between the flanges 14,15 of the upper panel-engaging portion 12.

In use, a housing 40 is fixed to the lower and side peripheral edges of a building aperture such as a door or window. The housing 40 comprises a number of holes (not illustrated) through which screws are passed to fix the housing 40 in position. A resilient layer is positioned between the housing 40 and the surface to which the housing 40 is to be secured, prior to the housing 40 being secured in position. The resilient layer forms thereby a water-proof seal to prevent flood water penetrating between the housing 40 and the building, A first panel 10 is slid down the side channels 44 until the panel 10 is located within the lower portion of the channel 44 which runs along the lower peripheral edge of the aperture. The seal formed between the panel 10 and the housing 40 prevents the entry of water between the panel 10 and the housing 40. As the water level rises, a second panel 10 is also slid down the side channels 44 of the housing 40. A seal is formed between the two panels 10, when the lower panel-engaging portion 13 of the second panel engages the upper panel-engaging portion 12 of the first panel. Where a sealing member 70 of the type shown in FIG. 7 is present, the sealing member 70 provides an additional seal between the two panels to prevent penetration of water.

The barrier can thus be increased in height, where it is anticipated that the flood water levels will continue to rise.

When the flood waters are receding, the panels can be successively removed and eventually, the housing 40 removed from the building. The apparatus can be conveniently stored until required again.

An alternative embodiment of a barrier which also includes additional sealing means is shown in FIGS. 8 to 15. The panel 80 is again essentially rectangular. As the panel 80 is hollow, the sides of the panel 80 are blanked off and seam welded to prevent water ingress to the inner volume of the panel 80. A number of ribs 80A strengthen the panel 80 to enable the panel 80 to withstand the pressure of the floodwater. The panel 80 has a curved tongue 81 along the in-use top edge. The tongue 81 engages a corresponding portion 82 on the bottom of a neighbouring panel. The material from which the tongue 81 is formed, although rigid, possesses a certain amount of resilience. The shape of the tongue 81 together with its resilience enables a second panel to be fitted easily into position whilst at the same time forming a seal.

Unlike the housing in the embodiments described above, the housing 83 does not have a U-shaped channel to receive the panels 80, but provides support to the panels 80 on only two sides. It has been found that the panels can be quickly and easily inserted into position. There is also reduction on wear on sealing members, as the frictional engagement between these sealing members when a panel is slid into position, can cause damage to the sealing members.

The panels 80 are held into position by means of a series of compression latches 90. Each compression latch enables the panel to be quickly and easily pulled against a housing 83. In order to achieve this, the compression latch 90 comprises a knob 91 which is rotationally mounted to a first end of a shaft 92. A gasket 93 is located between the knob 91 and the face of the panel 80. A mounting nut 94 and washer 95, together with a latch assembly 96 are mounted in water-tight fashion about the shaft 92 between the walls of the panel 80. At the second end of the shaft 92 is an offset pawl 97. By operation of the knob 91, the pawl 97 can be moved between a housing engaging and a release position. To assist the engagement the housing 83 includes a number of slots 98 to receive the pawl 97. To ensure a better seal as the pawl 97 enters the slot 98, the pawl 97 causes the panel 80 to be pulled towards the housing 83. This can be achieved either by offsetting the slot 98 or the pawl 97. Alternatively, a cam system can cause the force necessary.

In order to make the seal effective, a number of sealing elements can also be provided. For example, the panel 80 of FIG. 8 has neoprene blocks 99 both to provide a seal with neighbouring panels and also to prevent entry of water into the panel where the panel is hollow. Where such blocks 99 are present, the tongue 81 does not extend the whole length of the panel, but is cut away.

A moulding seal 130 runs the length of the housing 83 and provides an additional seal between the housing 83 and the panels. The moulding seal 130 includes flexible resilient projections 131 to improve the seal produced. A further closed cell, silicone strips 132 seals the gap between the housing and the structure to which it is mounted.

Figure 16:
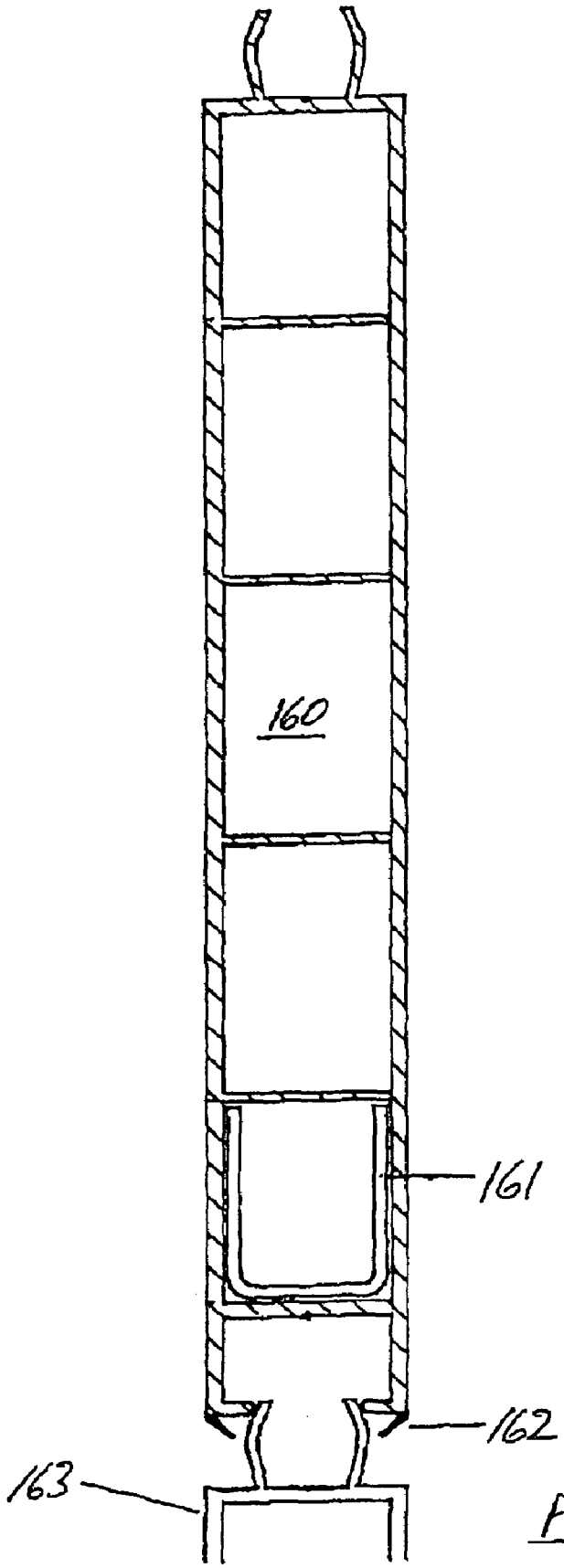
FIG. 16 is a further sectional view through the panel shown in FIG. 10.

The panel 160 in FIG. 16 includes a strengthening member 161 having a U-shaped section to increase the strength of the panel 160 and to minimise the amount by which the panel 160 bends under pressure from the water. The panel 160 also has two sealing strips 162 to further improve the seal formed with the neighbouring panel 163.

The panels can be made from a number of different materials, which are able to withstand the pressure of water without undergoing significant deformation. They can be formed, for example, from metal, wood or a suitable plastics material such as U-PVC. The panel should however be light enough to be easily lifted and positioned by the user. Aluminium has been found to be particular suitable in this respect.

The sealing material between the housing and the surface on which the housing is mounted is provided by a strip of resilient material. The material can therefore, under the pressure applied by fixing the housing in position, and also of the pressure of the flood water, flow into the shape into the shape of the surface, for example a wall or door sill, to give an improved seal. Where necessary, mastic sealant can also be applied, the mastic however being less easy to remove from the building and apparatus when the apparatus is dismantled from the building.

The dimensions of the elements of the apparatus will depend on the nature of the materials used in the construction and also on the size of the aperture to be protected. For example, where the material of construction is aluminum then (for a panel to cover the aperture of a main doorway) a height of 160 to 190 mm and a thickness of 20 to 30 mm for the main panel body has been found to be suitable. The height of the panel-engaging portions 12,13 can be 10 to 40 mm, but 20 to 30 mm has been found to be particularly suitable. The thickness of the walls for such an aluminium panel are typically from 1.5 to 5.0 mm in thickness, a thickness of from 2 to 3 mm being found to be particularly suitable. The thickness of the walls of the housing 40 are also from 2.0 to 5.0 mm in thickness, with 2.5 to 3.5 mm being preferred.

It will of course be understood that the invention is not limited to the specific details described herein, which are given by way of example only, and that various modifications and alterations are possible within the scope of the invention.

The invention claimed is:

1. An apparatus to protect an aperture of a building which aperture has a periphery, the apparatus acting to at least substantially hinder water from penetrating said aperture, the apparatus comprising:

a barrier housing removably fixable to at least a portion of the periphery of the aperture;

a barrier member sealingly engageable with said housing to provide a means for deterring floodwater from entering the building through said aperture, said barrier member comprising a relatively rigid panel and having upper and lower surfaces, wherein said barrier member is hollow and includes at least one strengthening member and wherein at least one strip of sealing material is provided along at least one of said upper and lower surfaces of said barrier member to increase the water resistant properties of the apparatus and wherein said barrier member includes a flange to retain said at least one strip of sealing material; and compression means for urging said barrier member into sealing engagement with said barrier housing.

2. The apparatus according to claim 1, wherein a resilient layer is included between said barrier housing and said barrier member biasing one part towards the other so as to provide improved sealing properties.

3. The apparatus according to claim 2, wherein said resilient layer is permanently attached within said barrier housing.

4. The apparatus according to claim 2, wherein said resilient layer includes at least one spline.

5. The apparatus according to claim 1, wherein said barrier member is planar and rectangular in shape.

6. The apparatus according to claim 1, additionally comprising sealing means disposable between said barrier housing and a building to prevent ingress of water between said housing and the building.

7. The apparatus according to claim 6, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

8. The apparatus according to claim 1, wherein said compression means includes a pawl having an offset elongate member, and said barrier housing has a slot, said pawl being rotatable between a rest position and a sealing position in which engagement of said member within said slot in said barrier housing causes said barrier housing and said barrier member to be urged together.

9. The apparatus according to claim 1, wherein said barrier member includes at least one barrier member-engaging portion to enable a number of barrier members to be fitted together to form a barrier of increased size.

10. An apparatus to protect an aperture of a building which aperture has a periphery, the apparatus acting to at least substantially hinder water from penetrating said aperture, the apparatus comprising:

a barrier housing removably fixable to at least a portion of the periphery of the aperture;

a barrier member sealingly engageable with said housing to provide a means for deterring floodwater from entering the building through said aperture, said barrier member comprising a relatively rigid panel and having upper and lower surfaces, wherein at least one strip of sealing material is provided alone at least one of said upper and lower surfaces of said barrier member to increase the water resistant properties of the apparatus and wherein said barrier member includes a flange to retain said at least one strip of sealing material;

compression means for urging said barrier member into sealing engagement with said barrier housing; and sealing means disposable between said barrier housing and a building to prevent ingress of water between said housing and the building.

11. The apparatus according to claim 10, wherein a resilient layer is included between said barrier housing and said barrier member biasing one part towards the other so as to provide improved sealing properties.

12. The apparatus according to claim 11, wherein said resilient layer is permanently attached within said barrier housing.

13. The apparatus according to claim 11, wherein said resilient layer includes at least one spline.

14. The apparatus according to claim 10, wherein said barrier member is planar and rectangular in shape.

15. The apparatus according to claim 10, wherein said barrier member is hollow and includes at least one strengthening member.

16. The apparatus according to claim 10, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

17. The apparatus according to claim 10, wherein said compression means includes a pawl having an offset elongate member, and said barrier housing has a slot, said pawl being rotatable between a rest position and a sealing position in which engagement of said member within said slot in said barrier housing causes said barrier housing and said barrier member to be urged together.

18. The apparatus according to claim 10, wherein said barrier member includes at least one barrier member-engaging portion to enable a number of barrier members to be fitted together to form a barrier of increased size.

19. The apparatus to protect an aperture of a building which aperture has a periphery, the apparatus acting to at least substantially hinder water from penetrating said aperture, the apparatus comprising:

a barrier housing removably fixable to at least a portion of the periphery of the aperture:

a barrier member sealingly engageable with said housing to provide a means for deterring floodwater from entering the building through said aperture, said barrier member comprising a relatively rigid panel, and having upper and lower surfaces, wherein at least one strip of sealing material is provided along at least one of said upper and lower surfaces of said barrier member to increase the water resistant properties of the apparatus, and wherein said barrier member includes a flange to retain said at least one strip of sealing material; and compression means for urging said barrier member into sealing engagement with said barrier housing wherein said compression means includes a pawl having an offset elongate member, and said barrier housing has a slot, said pawl being rotatable between a rest position and a sealing position in which engagement of said barrier member within said slot in said barrier housing causes said barrier housing and said barrier member to be urged together.

20. The apparatus according to claim 19, wherein a resilient layer is included between said barrier housing and said barrier member biasing one part towards the other so as to provide improved sealing properties.

21. The apparatus according to claim 20, wherein said resilient layer is permanently attached within said barrier housing.

22. The apparatus according to claim 20, wherein said resilient layer includes at least one spline.

23. The apparatus according to claim 19, wherein said barrier member is planar and rectangular in shape.

24. The apparatus according to claim 19, wherein said barrier member is hollow and includes at least one strengthening member.

25. The apparatus according to claim 19, additionally comprising sealing means disposable between said barrier housing and a building to prevent ingress of water between said housing and the building.

26. The apparatus according to claim 25, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

27. The apparatus according to claim 19, wherein said barrier member includes at least one barrier member-engaging portion to enable a number of barrier members to be fitted together to form a barrier of increased size.

28. The apparatus to protect an aperture of a building which aperture has a periphery, the apparatus acting to at least substantially hinder water from penetrating said aperture, the apparatus comprising:

a barrier housing removably fixable to at least a portion of the periphery of the aperture;

a barrier member sealingly engageable with said housing to provide a means for deterring floodwater from entering the building through said aperture, said barrier member comprising a relatively rigid panel; and compression means for urging said barrier member into sealing engagement with said barrier housing, wherein said compression means includes a pawl having an offset elongate member, and said barrier housing has a slot, said pawl being rotatable between a rest position and a sealing position in which engagement of said barrier member within said slot in said barrier housing causes said barrier housing and said barrier member to be urged together.

29. The apparatus according to claim 28, wherein a resilient layer is included between said barrier housing and said barrier member biasing one part towards the other so as to provide improved sealing properties.

30. The apparatus according to claim 29, wherein said resilient layer is permanently attached within said barrier housing.

31. The apparatus according to claim 29, wherein said resilient layer includes at least one spline.

32. The apparatus according to claim 28, wherein said barrier member is planar and rectangular in shape.

33. The apparatus according to claim 28, wherein said barrier member is hollow and includes at least one strengthening member.

34. The apparatus according to claim 28, additionally comprising sealing means disposable between said barrier housing and a building to prevent ingress of water between said housing and the building.

35. The apparatus according to claim 34, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

36. The apparatus according to claim 28, wherein said barrier member has upper and lower surfaces and wherein at least one strip of sealing material is provided along at least one of said upper and lower surfaces of said barrier member to increase the water resistant properties of the apparatus.

37. The apparatus according to claim 36, wherein said barrier member includes a flange to retain said at least one strip of sealing material.

38. The apparatus according to claim 28, wherein said barrier member includes at least one barrier member-engaging portion to enable a number of barrier members to be fitted together to form a barrier of increased size.

39. An apparatus to protect an aperture of a building which aperture has a periphery, the apparatus acting to at least substantially hinder water from penetrating said aperture, the apparatus comprising:

a barrier housing removably fixable to at least a portion of the periphery of the aperture;

a barrier member sealingly engageable with said housing to provide a means for deterring floodwater from entering the building through said aperture, said barrier member comprising a relatively rigid panel and having upper and lower surfaces, wherein said barrier member includes at least one barrier member-engaging portion to enable a number of barrier members to be fitted together to form a barrier of increased size and wherein said barrier member has at least one strip of sealing material is provided along at least one of said upper and lower surfaces of said barrier member to increase the water resistant properties of the apparatus and wherein said barrier member includes a flange to retain said at least one strip of sealing material; and compression means for urging said barrier member into sealing engagement with said barrier housing.

40. The apparatus according to claim 39, wherein a resilient layer is included between said barrier housing and said barrier member biasing one part towards the other so as to provide improved sealing properties.

41. The apparatus according to claim 40, wherein said resilient layer is permanently attached within said barrier housing.

42. The apparatus according to claim 40, wherein said resilient layer includes at least one spline.

43. The apparatus according to claim 39, wherein said barrier member is planar and rectangular in shape.

44. The apparatus according to claim 39, wherein said barrier member is hollow and includes at least one strengthening member.

45. The apparatus according to claim 39, additionally comprising sealing means disposable between said barrier housing and a building to prevent ingress of water between said housing and the building.

46. The apparatus according to claim 45, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

47. The apparatus according to claim 39, wherein said compression means includes a pawl having an offset elongate member, and said barrier housing has a slot, said pawl being rotatable between a rest position and a sealing position in which engagement of said member within said slot in said barrier housing causes said barrier housing and said barrier member to be urged together.

48. The apparatus to protect an aperture of a building which aperture has a periphery, the apparatus acting to at least substantially hinder water from penetrating said aperture, the apparatus comprising:

a barrier housing removably fixable to at least a portion of the periphery of the aperture;

a barrier member sealingly engageable with said housing to provide a means for deterring floodwater from entering the building through said aperture, said barrier member comprising a relatively rigid panel and wherein said barrier member is hollow and includes at least one strengthening member; and compression means for urging said barrier member into sealing engagement with said barrier housing wherein said compression means includes a pawl having an offset elongate member, and said barrier housing has a slot, said pawl being rotatable between a rest position and a sealing position in which engagement of said barrier member within said slot in said barrier housing causes said barrier housing and said barrier member to be urged together.

49. The apparatus according to claim 48, wherein a resilient layer is included between said barrier housing and said barrier member biasing one part towards the other so as to provide improved sealing properties.

50. The apparatus according to claim 49, wherein said resilient layer is permanently attached within said barrier housing.

51. The apparatus according to claim 49, wherein said resilient layer includes at least one spline.

52. The apparatus according to claim 48, wherein said barrier member is planar and rectangular in shape.

53. The apparatus according to claim 48, additionally comprising sealing means disposable between said barrier housing and a building to prevent ingress of water between said housing and the building.

54. The apparatus according to claim 53, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

55. The apparatus according to claim 48, wherein said barrier member has upper and lower surfaces and wherein at least one strip of sealing material is provided along at least one of said upper and lower surfaces of said barrier member to increase the water resistant properties of the apparatus.

56. The apparatus according to claim 55, wherein said barrier member includes a flange to retain said at least one strip of sealing material.

57. The apparatus according to claim 48, wherein said barrier member includes at least one barrier member-engaging portion to enable a number of barrier members to be fitted together to form a barrier of increased size.

58. The apparatus to protect an aperture of a building which aperture has a periphery, the apparatus acting to at least substantially hinder water from penetrating said aperture, the apparatus comprising:

a barrier housing removably fixable to at least a portion of the periphery of the aperture;

a barrier member sealingly engageable with said housing to provide a means for deterring floodwater from entering the building through said aperture, said barrier member comprising a relatively rigid panel;

compression means for urging said barrier member into sealing engagement with said barrier housing wherein said compression means includes a pawl having an offset elongate member, and said barrier housing has a slot, said pawl being rotatable between a rest position and a sealing position in which engagement of said barrier member within said slot in said barrier housing causes said barrier housing and said barrier member to be urged together; and sealing means disposable between said barrier housing and a building to prevent ingress of water between said housing and the building.

59. The apparatus according to claim 58, wherein a resilient layer is included between said barrier housing and said barrier member biasing one part towards the other so as to provide improved sealing properties.

60. The apparatus according to claim 59, wherein said resilient layer is permanently attached within said barrier housing.

61. The apparatus according to claim 59, wherein said resilient layer includes at least one spline.

62. The apparatus according to claim 58, wherein said barrier member is planar and rectangular in shape.

63. The apparatus according to claim 58, wherein said barrier member is hollow and includes at least one strengthening member.

64. The apparatus according to claim 58, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

65. The apparatus according to claim 58, wherein said barrier member has upper and lower surfaces and wherein at least one strip of sealing material is provided along at least one of said upper and lower surfaces of said barrier member to increase the water resistant properties of the apparatus.

66. The apparatus according to claim 65, wherein said barrier member includes a flange to retain said at least one strip of sealing material.

67. The apparatus according to claim 58, wherein said barrier member includes at least one barrier member-engaging portion to enable a number of barrier members to be fitted together to form a barrier of increased size.

68. An apparatus to protect an aperture of a building which aperture has a periphery, the apparatus acting to at least substantially hinder water from penetrating said aperture, the apparatus comprising:

a barrier housing removably fixable to at least a portion of the periphery of the aperture;

a barrier member sealingly engageable with said housing to provide a means for deterring floodwater from entering the building through said aperture, said barrier member comprising a relatively rigid panel, wherein said barrier member includes at least one barrier member-engaging portion to enable a number of barrier members to be fitted together to form a barrier of increased size; and compression means for urging said barrier member into sealing engagement with said barrier housing wherein said compression means includes a pawl having an offset elongate member, and said barrier housing has a slot, said pawl being rotatable between a rest position and a sealing position in which engagement of said barrier member within said slot in said barrier housing causes said barrier housing and said barrier member to be urged together.

69. The apparatus according to claim 68, wherein a resilient layer is included between said barrier housing and said barrier member biasing one part towards the other so as to provide improved sealing properties.

70. The apparatus according to claim 69, wherein said resilient layer is permanently attached within said barrier housing.

71. The apparatus according to claim 69, wherein said resilient layer includes at least one spline.

72. The apparatus according to claim 68, wherein said barrier member is planar and rectangular in shape.

73. The apparatus according to claim 68, wherein said barrier member is hollow and includes at least one strengthening member.

74. The apparatus according to claim 68, additionally comprising sealing means disposable between said barrier housing and a building to prevent ingress of water between said housing and the building.

75. The apparatus according to claim 74, wherein said sealing means is a strip of resilient material, and wherein when said strip is disposed between said housing and a building, said strip deforms under pressure to conform to a shape of at least one member selected from the group consisting of the building and the barrier housing to provide a water-tight seal.

76. The apparatus according to claim 68, wherein said barrier member has upper and lower surfaces and wherein at least one strip of sealing material is provided along at least one of said upper and lower surfaces of said barrier member to increase the water resistant properties of the apparatus.

77. The apparatus according to claim 76, wherein said barrier member includes a flange to retain said at least one strip of sealing material.

* * * * *